US005575044A

United States Patent [19]

Zornes

[11] Patent Number: 5,575,044

[45] Date of Patent: Nov. 19, 1996

[54] HIGH VISIBILTY BELT ASSEMBLY

[76] Inventor: David A. Zornes, 4348 - 202nd Ave. N.E., Redmond, Wash. 98053

[21] Appl. No.: 430,342

[22] Filed: Apr. 28, 1995

[51] Int. Cl.[6] ..... A44B 11/25

[52] U.S. Cl. ..... 24/168; 24/199; 24/305; 24/182

[58] Field of Search ..... 2/338, 311; 24/198, 24/168, 169, 164, 163 R, 182, 305, 199, 307, 319, 326, 459; 297/483

[56] References Cited

U.S. PATENT DOCUMENTS

| | | | |
|---|---|---|---|
| 460,447 | 9/1891 | Rosenberger | 24/182 X |
| 468,028 | 2/1892 | Wiedrich | 24/182 |
| 771,212 | 9/1904 | Selikowitz | 24/182 X |
| 1,100,389 | 6/1914 | Miller | 24/182 |
| 1,495,925 | 5/1924 | Quertermous | 24/182 |
| 1,698,530 | 1/1929 | Bieser | 24/163 R |
| 1,774,222 | 8/1930 | Bermejo et al. | 2/338 X |
| 2,644,994 | 7/1953 | Smith | 24/182 |
| 4,372,637 | 2/1983 | Lane et al. | 24/459 X |
| 4,447,913 | 5/1984 | Engelson | 24/338 |
| 4,501,028 | 2/1985 | Gottschall | 24/338 |
| 5,088,161 | 2/1992 | Robertson | 24/305 |
| 5,201,099 | 4/1993 | Campbell | 24/199 X |

*Primary Examiner*—James R. Brittain
*Attorney, Agent, or Firm*—Seed and Berry LLP

[57] ABSTRACT

A belt assembly has a belt with a retroreflective front side and one or more pairs of clip components snap-fitted thereon to grip the belt. Each clip component presents an integral leaf spring for fitting over a section of the belt.

19 Claims, 3 Drawing Sheets

HIGH VISIBILTY BELT ASSEMBLY

TECHNICAL FIELD

The present invention relates to high visibility belts worn to avoid injury in relatively poor visibility conditions, and to clips mounted on the belts to adjust their effective length instead of using buckles or slide elements.

BACKGROUND OF THE INVENTION

High visibility belts are frequently worn by various personnel to avoid accidental injury from engagement by vehicles and other mobile equipment under conditions where the equipment operators might not otherwise be sufficiently visually alerted to the presence of the belt wearer in the path of the equipment to avoid injurious contact. High visibility adjustable length belts having retroreflective front sides are well known in which length adjustment and fastening has been provided by use of two bar and three bar slide elements through which the belt is looped and by hook and loop type fasteners. However, there has been a need for a more versatile high visibility unit.

SUMMARY OF THE INVENTION

The present invention provides a high visibility belt having clips mounted thereon, preferably by a snap fit. The clips each have one or two spring leaf elements for fitting over an overlapped portion of the belt so that the belt can be worn as a waist belt or as a shoulder sash, for example, with end portions overlapping and held in position by one or more of the clips. Shorter lengths of the belt can be used as bands mounted by the clips onto articles of clothing.

DETAILED DESCRIPTION OF THE INVENTION

Figure 1:
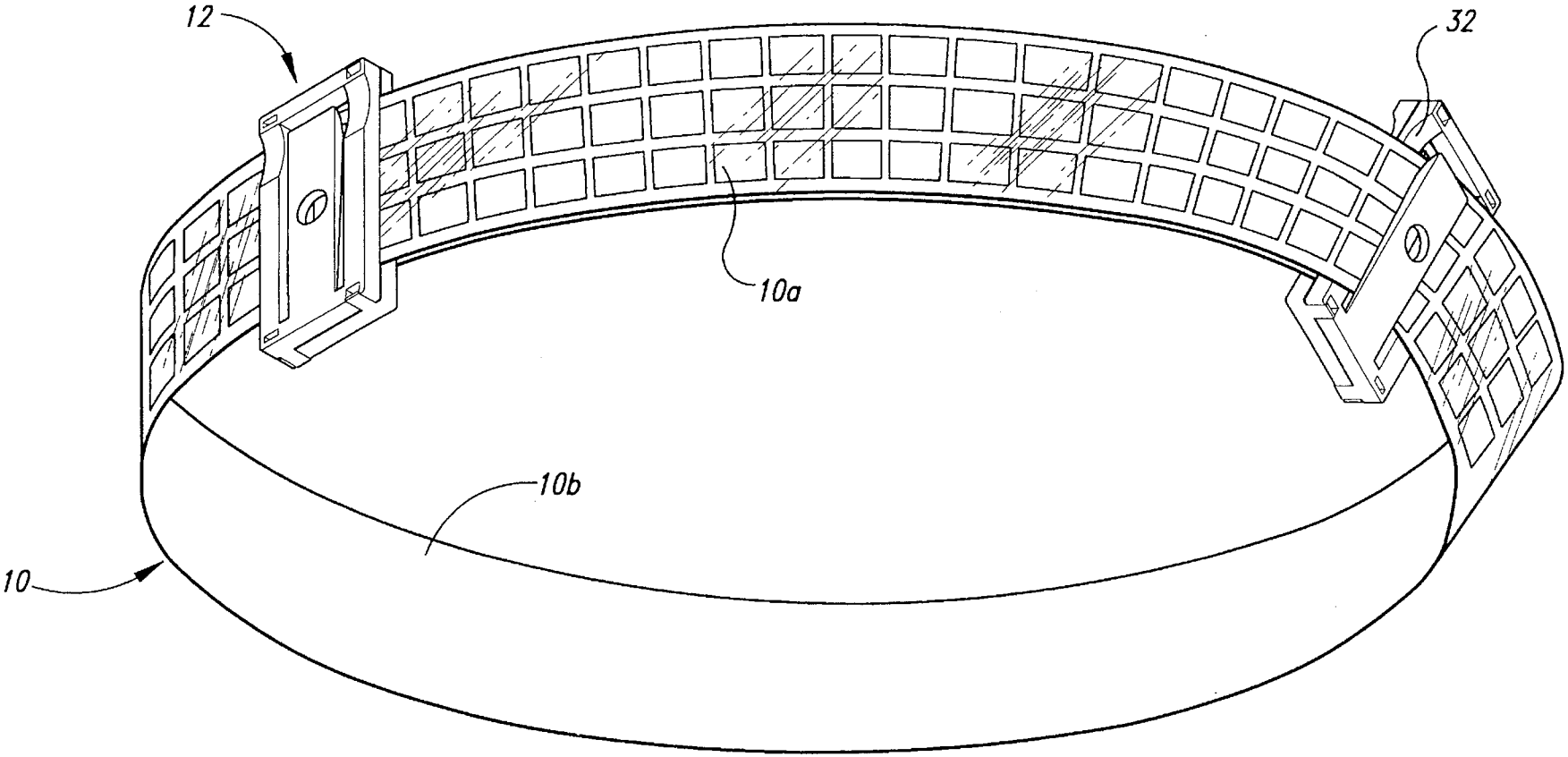
FIG. 1 is a perspective view of a length of belt with clips in accordance with the present invention.
Figure 2:
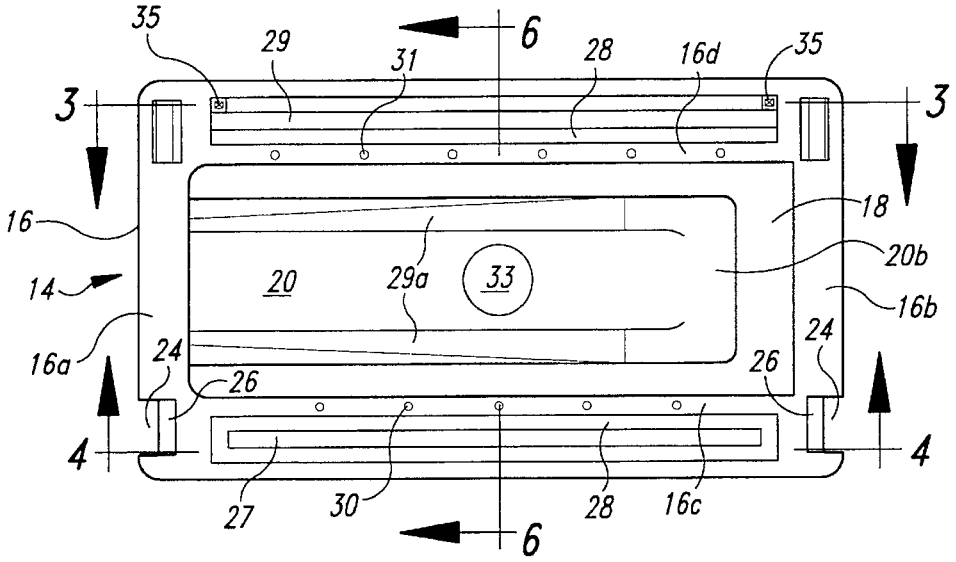
FIG. 2 is a plan view of one of the clip components.
Figure 3:
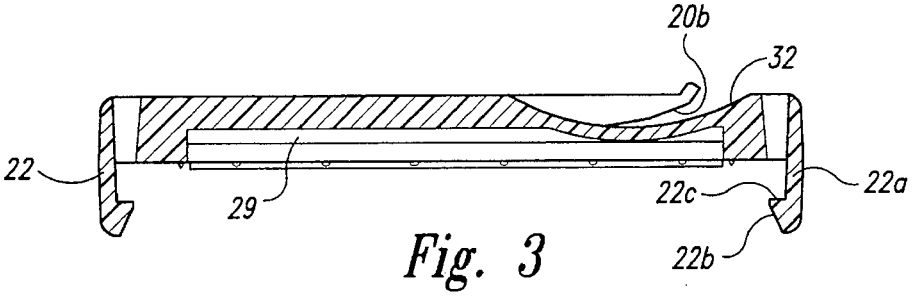
FIG. 3 and 4 are longitudinal sectional views taken as indicted lines 3—3 and 4—4 in FIG. 2.
Figure 4:
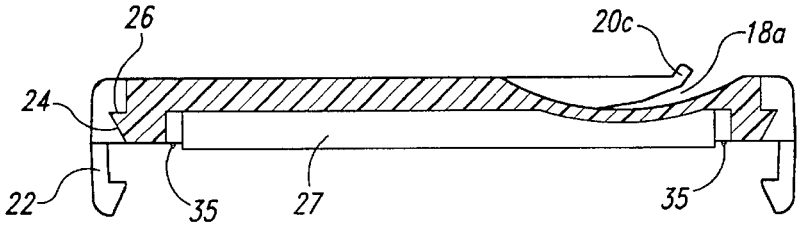
Figure 5:
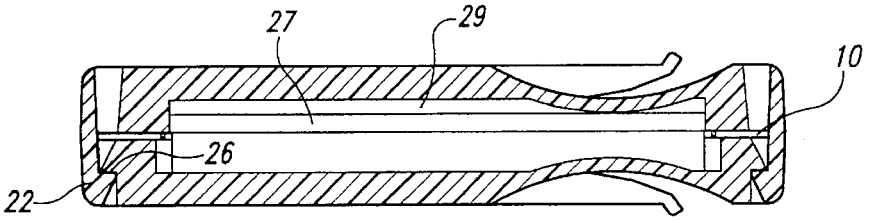
FIG. 5 is a longitudinal sectional view of the clip showing of the clip components snap-fitted together.
Figure 6:
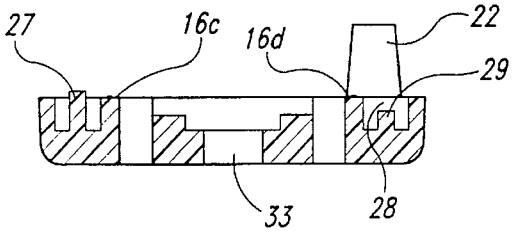
FIG. 6 is a transverse section view of one of the clip components taken as indicated by line 6—6 of FIG. 2.
Figure 7:
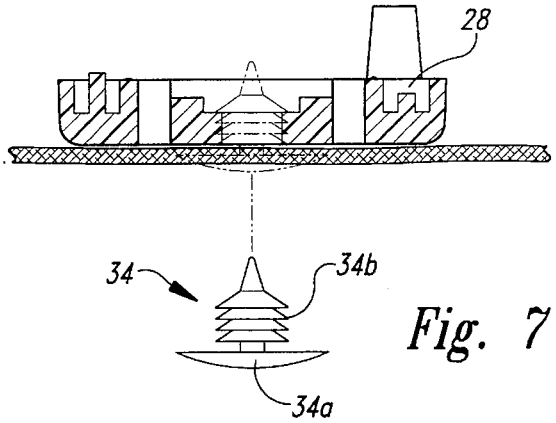
FIG. 7 is an exploded view showing insertion of a ratchet type fastener.

Referring to the drawings it is seen that the safety belt assembly of the present invention comprises a belt 10 with a front retroreflective side 10*a* and a back side 10*b* on which injection-molded plastic mounting clips 12 are mounted. The belt preferably comprises a front tape having an array of microscopic cube corner prisms supported by high polished UV stabilized plasticized polyvinyl chloride film. The retroreflective tape may have a grid pattern of squares with the exposed prism side of the retroreflective material centrally welded to a plastic coated cloth backing.

The clips 12 preferably comprise a pair of like clip components 14 which are snap-fitted together over the belt from opposite sides. Each component 14 has a rectangular border frame 16 with end sections 16*a*–16*b* and longitudinal side sections 16*c*–16*d* meeting at corner portions and surrounding an opening 18. This opening is occupied in part by a spring leaf 20 having its root end integrally attached to end section 16*a* of the frame 16. The back side of the spring leaf 20 has a pair of longitudinal clamping ribs 20*a* along most of its length and then has a sloped back guide face 20*b* adjoining its free end. Preferably the spring leaf slopes slightly from its root end toward the back of the clip component.

Each clip component has a pair of locking elements 22 projecting rearwardly from the corner portions of the border frame at the ends of longitudinal section 16*d*, and has a pair of complementing keeper recesses 24 in the other two corner portions. Ledges 26 in the recesses 24 face forwardly oppositely from the projecting direction of the locking elements 22. The latter have a general hook configuration with a stem 22*a* and a bill which is formed with a sloped guide face 22*b* joining a locking face 22*c*. The stem 22*a* is sufficiently resilient to be flexed oppositely from the guide face 22*b* and to then return to its normal position.

Figure 8:
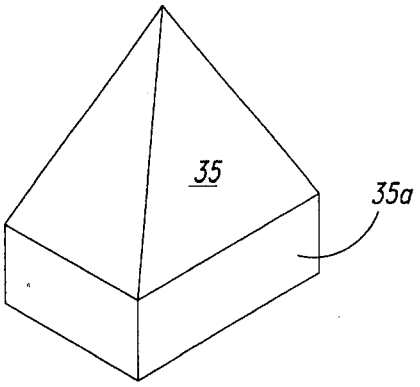
FIG. 8 is a perspective view of one of the corner protuberances.
Figure 9:
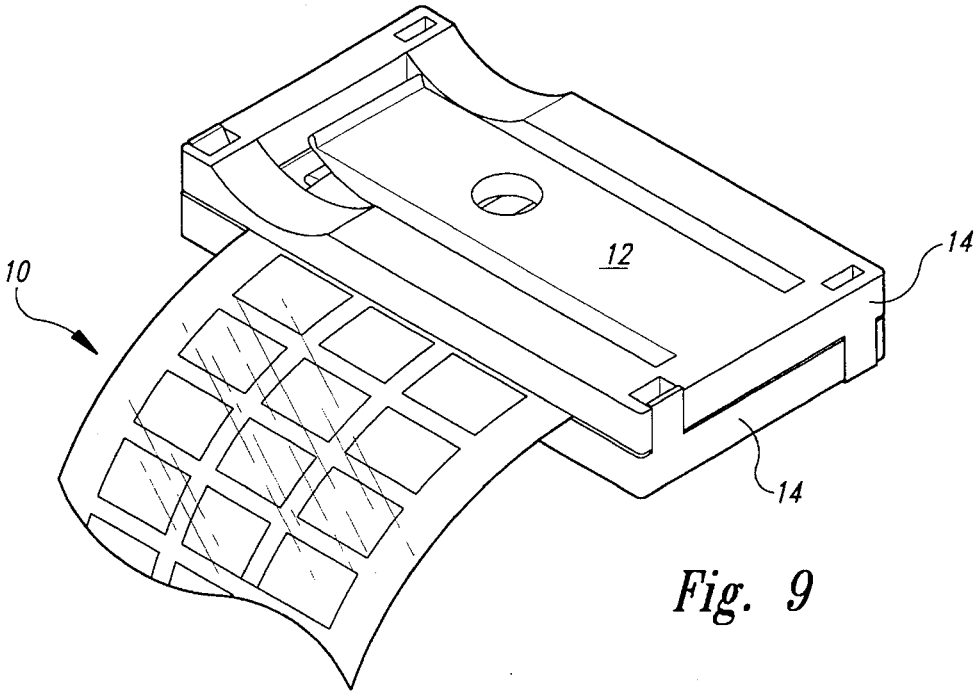
FIG. 9 is a perspective view of one of the clips applied to a belt.

The clip components each have a longitudinal gripping rib 27, projecting rearwardly a short distance from the longitudinal side section 16c. This rib is complemented by a recess 28 along the center of the other longitudinal side section 16d and a raised bottom rib 29 in the recess 28 which is spaced below the mouth of the recess 28 by a distance corresponding approximately to the projecting distance of the gripping rib 27 above the side section 16*c* plus the thickness of the belt 10. It will be understood that the bottom rib 29 could be eliminated by having the entire bottom face of the recess 28 at the level of the upper face of the rib 29. It is preferred to provide a longitudinal row of short pointed gripping protuberances 30, 31 along the back side of each of the longitudinal side sections 16*c*, 16*d* between the gripping rib 27 and the recess 28, and to stagger the rows. It is also preferred to provide pointed protuberances 35 at the outer corners of the recess 28 which are shaped as shown in FIG. 8. These protuberances 35 are preferably of a length to project into the cavity 28 of the complementing clip component when the pair of clip components are snapped together over a section of the belt. As a consequence the protuberances 35 normally punch through the belt to the extent that a square base portion 35*a* of the protuberances occupies a locking position within the belt structure.

When the clip 12 is to be assembled a pair of the clip components 14 are positioned on opposite sides of a belt 10 so that the hook elements 22 on each component 14 are directed toward the recesses 24 of the other component. The components are then pressed together over the belt. While the components are being pressed together the hook elements 22 spring sufficiently outwardly away from one another by engagement of the sloped guide faces 22*b* with the inner face of the recesses 24 for the locking faces 22*c* to reach the level of the ledges 26 whereupon the hook elements 22 snap inwardly so that the locking faces 22*b* seat upon the ledges 26, thereby keeping the clip components locked together over the belt. When the clip components are locked together the belt is gripped and crimped between the projecting ribs 27 and complementing recessed ribs 29 in the longitudinal recesses 28 at both longitudinal sides of the clip. The crimping action on the belt by the ribs keeps the clip from sliding along the belt after being applied. This slide preventing action of the ribs is supplemented by slight biting of the protuberances 30, 31 into the belt.

Preferably the front face of each longitudinal side section 16*c*–16*d* of the clip components is formed with a concave arcuate guide face 32 adjacent the end section 16*c*–16*d*. Also, it is preferred to provide the outer end of the spring leafs 20 with a tipped-up guide portion 20*c*. These guide faces 32 are on opposite sides of the free end portion of the spring leaf 20 and functionally complement the guide portion 20*c* and sloped back guide face 20*b* of the spring leaf when a section of the belt or a portion of wearing apparel is to be gripped by the spring leaf.

The clips 12 may be clamped at regular intervals, six inches, for example, along of several feet of belt 10 and the desired length of belt cut off so that the severed piece has one or more clips. Various lengths of belt may be selected for various uses. If a waist band is desired, clips may be positioned adjacent the ends of the belt. Then, after the belt is looped around the waist, the free end portions of the belt are overlapped and the back spring leaf on the front overlapping section of the belt is fitted over the back overlapped section of the belt, and the front spring leaf of the clip on the back overlapped section is fitted over the front overlapping section of the belt. As previously indicated, fitting of a spring leaf over the belt is assisted by the sloped back guide face 20*a* of the spring leaf and the adjacent arcuate concave guide faces 32 as an edge portion of the belt is introduced into the gap 18*a* adjoining the free end of the spring leaf and is guided to the back side of the spring leaf 20. The spring leaf will responsively spring outwardly sufficiently for the belt to fit behind the leaf. An arm, wrist, leg, ankle, or head band, for example, can be made by use of a single clip clamped in position at one end of the band and overlapping the other end portion of the band with the back spring leaf fitting thereover. In the alternative such other end portion of the band can overlap the clip and be engaged by the front spring leaf of the clip. Rather then forming a belt or band with overlapping sections gripped by a clip(s), a length of the belt may be mounted by use of the spring leafs 20 on its clip or clips as a reflector strip onto an article of clothing such, for example, as a hat, shirt, vest, suspender, jacket, coat or pants, or an existing belt, with the retroreflective side exposed.

It will be noted that each spring leaf has a central hole 33 therethrough. This hole is provided to selectively receive a suitable fastener such as ratchet type nylon fastener 34 having a domed head 34*a* and a shank with a series of flexible ribs 34*b* that deflect adequately to pass through the hole 33 and then snap back to retain the fastener. The outer end of the shank is pointed so that the fastener 34 can more easily be guided through the hole 33 and pushed through woven fabric or other suitable material on which a length of the belt is mounted as a reflector strip. This arrangement permits the clip to be more securely anchored in position. It is also understood that the fastener 34 can be passed through hole 33 providing additional point pressure to the spring leaf 20. In place of the ratchet fastener a removable pressure fit fastener may be used for a temporary connect and disconnect application.

A ratchet type fastener of the type having ribbed shanks at both ends like the shank of fastener 34 can be used to pivotally secure two clips together face to face with the double-ended fastener engaged in two of the holes 33. This arrangement is convenient for pivotally connecting the opposite ends of a belt together when the belt is to be worn in the manner of a shoulder sash.

From the foregoing it will be appreciated that, although specific embodiments of the invention have been described herein for purposes of illustration, various modifications may be made without deviating from the spirit and scope of the invention. Accordingly, the invention is not limited except as by the appended claims.

In the following claims, "belt" shall be interpreted broadly as including bands, strips and straps, for example.

I claim:

1. A clip comprising:

two interfitting clip components jointly presenting a belt passage therebetween;

said clip components each having a spring leaf, said spring leafs being spaced apart along a central portion of said belt passage, and each leaf being adapted to be sprung away from the other spring leaf into gripping position over material inserted between the spring leaf and the remainder of the respective clip component.

2. A clip according to claim 1 in which said clip components are identical and are adapted to be snap-fitted together over a length of belting.

3. A clip according to claim 1 in which said clip components present opposed belt gripping parts located on opposite sides of said belt passage and spaced from said spring leafs.

4. An adjustable belt assembly comprising a length of belting;

a pair of clips fitting in opposing relation to one another over said belting adjacent opposite ends thereof; each of said clips having a spring leaf arranged to fit over the belting when the belting is formed in a closed loop with the clips overlapping spaced-apart portions of the belting whereby the size of the loop can be adjusted.

5. An adjustable belt assembly according to claim 4 in which said belting has reflective elements thereon.

6. An adjustable belt assembly according to claim 4 in which each of said clips has a pair of interfitting clip components snap-fitted together over said belting and each includes a said spring leaf as an integral part thereof.

7. An adjustable belt assembly according to claim 4 in which each of said clip components is a molded plastic part.

8. An adjustable belt assembly according to claim 4 in which each of said clips has two interfitting rectangular frames on opposite sides of said belting, each said frame having two end members and two longitudinal members joined together at corner portions at which the frames are interfitted, each of said frames having a said spring leaf cantilevering from one its said end members in spaced relation to its said longitudinal members and the other of its end members.

9. An adjustable belt assembly according to claim 8 in which said interfitting frames interfit by way of pairs of resilient hook elements interfitting with pairs of keeper recesses at said corner portions, each of said frames having a pair of said hook elements and a pair of said keeper recesses.

10. A clip component comprising:

a generally rectangular frame having two end members joining two longitudinal members at four corner portions of the frame, said frame having a front side and a back side, a spring leaf cantilevering integrally from one of said end members toward the other end member in spaced relation to said longitudinal members and said other end member, one of said longitudinal members having a longitudinal gripping rib at the back side and the other of said longitudinal members having a complementing longitudinal recess at the back side arranged such that a pair of said clip components can be positioned back side to back side with the gripping rib of each occupying the complementing recess of the other and providing clearance for belting gripped between said clip components in said recesses;

and locking means at said corner portions for locking a pair of said clip components together over a length of belting.

11. A clip component according to claim 10 in which the longitudinal member having said gripping rib has pointed protuberances therealong adjacent said rib.

12. A clip component according to claim 10 in which said locking means comprises resilient locking hooks fitting into recesses having keeper ledges engaged by bills on said hooks.

13. A clip component according to claim 10 in which said longitudinal members have rounded concave guide portions at the front side adjacent a free end portion of said spring leaf, and said free end portion has a sloped guide face at its back side.

14. A clip component according to claim 10 in which said spring leaf has a central hole for receiving a fastener.

15. A clip component comprising:

a generally rectangular frame surrounding an open area and having first and second end members joining first and second longitudinal gripping members at four corner portions of the frame;

a spring leaf having a root end joining said first end member and projecting longitudinally into said open area between said longitudinal members, said spring leaf being spaced by respective side gaps from said longitudinal members and having a free end spaced by an end gap from said second end member, said frame having a pair of locking elements both projecting in a first direction from two of said corner portions and having complementing keeper recesses at the other two of said corner portions, said locking elements and recesses being shaped such that a pair of the clip components will snap fit together when they are positioned with their locking elements occupying the recesses of the other clip component, and shaped such that a belt passage from longitudinal side to longitudinal side is provided between the pair of clip components when they are snap fitted together over a length of belting gripped between said longitudinal members.

16. A clip component according to claim 15 in which said locking elements each have a locking hook and said keeper recesses each have a keeper ledge facing in a second direction opposite from said first direction, said locking hooks having bills to engage said keeper ledges when a pair of the clip components are snap fitted together.

17. A clip component according to claim 15 in which one of said longitudinal gripping members has a gripping rib and the other longitudinal gripping member has a complementing recess.

18. A belt assembly comprising:

a belt, a clip on said belt and comprising two like clip components secured together over the belt in clamping relation and presenting respective integral clamping leafs adapted to fit over an overlapping portion of the belt, each of said clip components having a generally rectangular border frame with a central opening occupied by the respective clamping leaf, said leaf projecting into said central opening from said frame.

19. A belt assembly according to claim 18 in which the border frame of each clip component has a pair of locking elements each interfitting with a complementing locking element on the other frame.

* * * * *